US008287962B2

(12) United States Patent
Reagan et al.

(10) Patent No.: US 8,287,962 B2
(45) Date of Patent: Oct. 16, 2012

(54) PAPER SURFACE TREATMENT COMPOSITIONS

(75) Inventors: Eugene Reagan, Chester, SC (US); James Vaughn, Hudson, OH (US)

(73) Assignee: OMNOVA Solutions Inc., Fairlawn, OH (US)

( * ) Notice: Subject to any disclaimer, the term of this patent is extended or adjusted under 35 U.S.C. 154(b) by 299 days.

(21) Appl. No.: 12/602,360

(22) PCT Filed: May 30, 2008

(86) PCT No.: PCT/US2008/006844

§ 371 (c)(1), (2), (4) Date: Jan. 26, 2010

(87) PCT Pub. No.: WO2008/153837

PCT Pub. Date: Dec. 18, 2008

(65) Prior Publication Data

US 2010/0173169 A1 Jul. 8, 2010

Related U.S. Application Data

(60) Provisional application No. 60/961,833, filed on Jul. 24, 2007, provisional application No. 60/932,386, filed on May 30, 2007.

(51) Int. Cl.
*B05D 5/00* (2006.01)

(52) U.S. Cl. ..... 427/384; 427/385.5; 427/389.9; 427/391; 427/392; 427/394; 427/395; 427/396

(58) Field of Classification Search ..... None
See application file for complete search history.

(56) References Cited

U.S. PATENT DOCUMENTS

| | | | | |
|---|---|---|---|---|
| 3,438,808 | A | 4/1969 | Hawkins et al. | |
| 3,600,342 | A * | 8/1971 | Nickerson et al. | 524/46 |
| 3,720,633 | A | 3/1973 | Nickerson | |
| 4,537,634 | A | 8/1985 | Floyd | |
| 4,537,807 | A | 8/1985 | Chan et al. | |
| 4,695,606 | A | 9/1987 | Floyd et al. | |
| 4,904,519 | A | 2/1990 | Newman | |
| 5,032,683 | A | 7/1991 | Dragner et al. | |
| 5,292,782 | A | 3/1994 | Bastioli et al. | |
| 5,395,440 | A | 3/1995 | Trouve | |
| 6,419,987 | B1 | 7/2002 | Bauer et al. | |
| 2004/0013825 | A1 | 1/2004 | Chen | |
| 2004/0065423 | A1 | 4/2004 | Swerin et al. | |
| 2004/0102546 | A1 | 5/2004 | Skuratowicz et al. | |
| 2006/0252855 | A1 * | 11/2006 | Pisanova et al. | 524/47 |
| 2008/0014360 | A1 * | 1/2008 | Kim | 427/384 |

FOREIGN PATENT DOCUMENTS

| | | | |
|---|---|---|---|
| DE | 10 2004 008360 | A1 | 9/2004 |
| WO | WO 02/02412 | A2 | 1/2002 |
| WO | WO 2006/011948 | A1 | 2/2006 |

OTHER PUBLICATIONS

Nickerson, R. F., "Thickening of Poly(vinyl Alcohol) by Borate", J. Applied Polymer Science, vol. 15, pp. 111-116 (1971).

* cited by examiner

*Primary Examiner* — Erma Cameron

(74) *Attorney, Agent, or Firm* — Renner, Kenner, Grieve, Bobak, Taylor & Weber; David G. Burleson

(57) ABSTRACT

A method of preparing a surface-treated cellulosic substrate, the method comprising applying a surface treatment composition to a cellulosic substrate, the composition being prepared by a method comprising the steps of introducing a source of boron, a crosslinking di-aldehyde, and a blocking agent to form a crosslinking composition; introducing the crosslinking solution with starch and optionally pigments and/or optionally polymeric particles to form the composition.

18 Claims, No Drawings

PAPER SURFACE TREATMENT COMPOSITIONS

This application claims the benefit of International Application Serial No. PCT/US2008/006844, filed on May 30, 2008, U.S. Provisional Application Ser. No. 60/961,833, filed Jul. 24, 2007 and U.S. Provisional Application Ser. No. 60/932,386, filed May 30, 2007, all of which are incorporated herein by reference.

FIELD OF THE INVENTION

One or more embodiments of the present invention relate to surface treatment compositions for cellulosic substrates.

BACKGROUND OF THE INVENTION

Paper coating compositions are generally a fluid suspension of pigment, such as clay and calcium carbonate with or without titanium dioxide in an aqueous medium with a binder such as soluble starch, modified soluble starch, styrene-butadiene copolymer emulsion, styrene-acrylic copolymer emulsion, and/or soluble modified protein to adhere the pigment to paper. Other functional or processing additives can be added in small amounts to impart properties such as thickening, lubricity, hydrophobicity, foam control, and/or anti-microbial properties and the like. For paper sizing, the main component is a starch solution, with or without inorganic pigments, and sometimes an emulsion binder to impart paper strength and repellency to water, especially during printing.

The hydrophilic nature of the binder, particularly the starch solutions, requires the presence of an insolubilizing material that crosslinks the binder making it hydrophobic, hydrophobicity in coated or sized papers is important to enable the paper to be processed through high-speed offset printing presses and can improve the printability characteristics of the surface of the coated paper. Common crosslinking materials are glyoxal resins and formaldehyde-donor agents such as melamine-formaldehyde, urea-melamine-formaldehyde, and partially or wholly methylated derivatives thereof.

Blocked glyoxal insolubilizers allow for the water resistance that is particularly critical in web offset printing, the most common commercial printing process, where aqueous dampening fountain solutions are employed. If natural binders, such as starch, in the coating formulations are not insolubilized, piling and poor dot definition results on printing press. Increases in press speed and consequent changes in ink chemistry and fountain solutions caused reassessment of the nature of coated paper and paperboard surfaces. Past coatings have been designed to achieve high levels of wet rub resistance, but this is no longer true. High speed printing processes require rapid acceptance of aqueous and oily fluids to obtain high quality print.

Insolubilizers are believed to react with hydroxyl (—OH) groups associated with starch or amino groups on protein. The amino group or hydroxyl group reacts with organic compounds such as aldehyde donors. This basic reaction between the aldehyde and the hydroxyl group of polymers such as starch is responsible for insolubilization.

The aldehyde group may be supplied by many donors. The selection of chemical type depends upon operating conditions, preparation and economic factors. The rate at which coating insolubilization is developed and the degree required covers a wide range depending on the end use. Most common paper coating and sizing insolubilizers are reacted glyoxal type compounds. Once reacted in the coating structure, the insolubilizer forms hemiacetal groups which crosslink the binder and increase water resistance. The reaction of polyol-carbonyl adducts provides the formulator a highly reactive molecule with controlled viscosity.

Glyoxal is a highly reactive monomer that cures quickly and has excellent insolubilizing properties, particularly with starch. The rapid reaction between glyoxal and binder, however, increases the viscosity of the coating composition thereby making processing of the coating difficult. Frequently, glyoxal-insolubilized coatings gel completely particularly in high solids formulations. Gelling can also occur in moderate or low solids formulations if they are not used promptly. Thus in situations where it is required that the viscosity remain stable for many hours, or where high-solids paper coatings are to be applied by high-speed coating techniques, a pure glyoxal system may be unsuitable.

Blocked or reacted glyoxal resins have been used to overcome some of the deficiencies associated with glyoxal. For example, U.S. Pat. No. 4,537,634 teaches urea, cyclic amide condensates, or polyol carbonyl adducts as blockers.

U.S. Pat. No. 4,695,606 teaches the use of blocked glyoxal, which can be mixed with binders such as starch, without reacting to any great degree. The reactivity of these blocked glyoxals, however, can be controlled so that they crosslink with the binder upon drying.

Glyoxal based insolubilizers provide advantageous insolubilization in a slightly alkaline coatings (7-8 pH), but performance drops off rapidly as the coating pH increases above pH 9. High pH (>9.0) is believed to deleteriously impact the glyoxal. Lowering the pH may not unblock and liberate the glyoxal for insolubilization. The reaction of glyoxal with free hydroxide to form a glycolate ion is known as the Cannizaro reaction and results in poor coating insolubility. When the pH of a size press or coating formulation exceeds approximately 8.5, glycolate ions are produced rapidly and the efficiency of the glyoxal based insolubilizer is substantially reduced.

SUMMARY OF THE INVENTION

One or more embodiments of the present invention provides a method of preparing a surface-treated cellulosic substrate, the method comprising applying a surface treatment composition to a cellulosic substrate, the composition being prepared by a method comprising the steps of introducing a source of boron, a crosslinking di-aldehyde, and a blocking agent to form a crosslinking composition; introducing the crosslinking solution with starch and optionally pigments and/or optionally polymeric particles to form the composition.

One or more embodiments of the present invention also provides a crosslinking composition for use in surface treatment composition for surface treating cellulosic substrates, the composition comprising being prepared by introducing a source of boron, a di-aldehyde, and a blocking agent to form a crosslinking composition.

One or more embodiments of the present invention also provides a surface treatment composition comprising the mixture, complex, or reaction product of starch, a source of boron, a dialdehyde, and a blocking agent.

One or more embodiments of the present invention also provides a treated cellulosic substrate prepared by applying a surface treatment composition to a cellulosic substrate, the surface treatment composition being the mixture of, complex of, or reaction product of a source of boron, a di-aldehyde, a blocking agent, and starch.

DETAILED DESCRIPTION OF THE ILLUSTRATIVE EMBODIMENTS

It has unexpectedly been discovered that surface treatment compositions, including paper surface sizings and pigmented coatings, that are prepared by introducing certain crosslinking compositions with starch provide for sizing and coating compositions that have technologically advantageous processability and provide for finished products that demonstrate technological advantages. The crosslinking composition may be prepared by introducing (i) a source of boron, (ii) a crosslinking aldehyde, and (iii) a blocking agent. The sizing and pigmented coating compositions may also include pigments, polymeric particles, and/or other additives conventionally included in paper and paperboard surface treatment compositions. The use of surface treatment compositions and common aspects and/or ingredients of surface treatment compositions are disclosed in U.S. Pat. Nos. 4,537,634, 5,032,683 and 4,695,606, which are incorporated herein by reference.

In one or more embodiments, the source of boron includes a material that supplies borate ions in solution. For instance, the alkali metal and the alkaline earth metal borates and boric acid may be employed. Particular examples include sodium borate decahydrate, disodium tetraborate decahydrate, disodium tetraborate pentahydrate, and disodium tetraborate heptahydrate.

In one or more embodiments, crosslinking aldehydes include dialdehydes having about 2-4 carbon atoms, keto aldehydes having about 3-4 carbon atoms, hydroxy aldehydes having about 2 to 4 carbon atoms, ortho substituted aromatic dialdehydes, and ortho substituted aromatic hydroxyl aldehydes. Examples include glyoxal, propane dialdehyde, 2-keto propanal, 1,4-butanedial, 2-keto butanal, 2,3-di keto dibutanal, phthaldehyde, salicaldehyde, and mixtures thereof.

In one or more embodiments, blocking agents include compounds that bind chemically to the borate ions. In these or other embodiments, blocking agents include compounds that bind chemically to the crosslinking aldehyde and upon a threshold level of dehydration, will allow the crosslinking aldehyde to react and crosslink the starch. Suitable blocking agents include, for instance, polyhydric alcohols such as pentaerythritol, glycerin, lanolin, mono and oligosaccharides having multiple hydroxyl groups, and mixtures thereof. In particular embodiments, the blocking agent is sorbitol, which is a reduced sugar.

In one or more embodiments, useful starches include amylose and amylopectin containing starch. The starch may be obtained from any conventional source, including potato, corn, waxy corn, red milo, white milo, wheat and tapioca and may be a dextrin, maltodextrin, cyclodextrin, oxidized, hydroxyalkylated, acid modified, cationic, enzyme converted or various combinations thereof. In one or more embodiments, thin-boiling starches that have been additionally chemically modified to reduce the setback or retrogradation tendencies of the starch may be employed. The prior art describes methods for making a wide variety of starch derivatives that display reduced setback. Because of the low cost and effectiveness for reducing setback, it may be desirable to employ a thin-boiling starch derivative such as oxidized, hydroxyethyl starch, starch phosphate, hydroxyethyl starch phosphate, starch acetate, starch propionamide and starch maleate. These derivatives may be used alone or in combination with thin-boiling starches, maltodextrins or dextrins to provide for a lower cost or to obtain desired viscosity characteristics. Maltodextrins or dextrins may be used alone as the starch component of this invention because dextrins and maltodextrins can be pregelatinized in their manufacture. In certain embodiments, a blend of hydroxyethylated starch and an acid- and/or enzyme-converted starch or dextrin may be utilized. For example, dextrins and/or maltodextrins may be utilized together with an acid-modified or an oxidized hydroxyethylated starch such as a hydroxyethylated potato starch. Cationic potato starch, oxidized corn starch, acid-modified corn starch, and enzyme-modified corn starch may also be used. Waxy starches that do not contain amylase can also be used.

In one or more embodiments, natural starch may be used. In other embodiments, modified starch may be used. The modified starch may include ethoxylated or hydroxylated starch, peroxide or acid treated starch, or cationized starch.

In one or more embodiments, pigments may include clay, titanium dioxide, gypsum, talc, and/or calcium carbonate, and the like, and mixtures thereof. In certain embodiments, the pigment is entirely or substantially comprised of calcium carbonate. The clay may include kaolin or English clay. The calcium carbonate may include ground and precipitated calcium carbonate. In these or other embodiments, plastic pigments, such as polystyrene pigments, may be employed.

In one or more embodiments, polymeric particles (i.e. polymer suspended in aqueaous media including latex) may include elastomeric particles such as those synthesized from styrene and butadiene monomer together with optional comonomer such acrylic, methacrylic, acetate, and acid monomer. Other polymeric particles may include polyvinyl acetate particles. These polymeric particles are conventionally in the form of a polymeric latex.

In addition to the ingredients discussed above, the composition of this invention may be prepared by including other ingredients such as dispersants (e.g. sodium hexametaphosphate, sodium polyacrylate), lubricants (e.g. calcium stearate), defoamers (e.g. oil based emulsions or ethyl alcohol), preservatives, colored pigments, viscosity modifiers (e.g. carboxymethylcellulose, acrylate thickeners, polyvinyl alcohol), and the like, in conventional amounts.

In one or more embodiments, the crosslinking composition may be prepared by introducing (i) a source of boron, (ii) a crosslinking aldehyde, and (iii) a blocking agent. In particular embodiments, a source of boron (e.g. borate salt) is added to an aqueous solution of crosslinking aldehyde (e.g. glyoxal), and then a neutralizing agent (e.g. sodium hydroxide) is added to the solution in an effort to maintain the pH of the solution above 4, which facilitates the dissolving of the source of boron (e.g. borate salt) into the solution. The blocking agent (e.g. sorbitol) can then be added to form the crosslinking composition. In other embodiments, the addition order of the ingredients can be altered. In yet other embodiments, the addition of the various ingredients can be split. For example, a portion of the crosslinking aldehyde can be combined with the borate, and then the remainder of the crosslinking aldehyde can be added after the blocking agent is introduced.

In one or more embodiments, the pH of the crosslinking composition is adjusted (by using known techniques) to a pH of at least 4, in other embodiments at least 4.5, in other embodiments at least 5.0, in other embodiments at least 5.5, in other embodiments at least 6.0, and in other embodiments at least 6.5. In these or other embodiments, the pH of the crosslinking composition is adjusted to a pH of less than 10, in other embodiments less than 9.5, in other embodiments less than 9.0, in other embodiments less than 8.5, in other embodiments less than 8.0, and in other embodiments less than 7.5.

In one or more embodiments, the crosslinking composition is an aqueous composition. In one or more embodiments, the source of boron, the crosslinking aldehyde, and the blocking agent are dissolved in the aqueous composition. In particular embodiments, the source of boron, the crosslinking aldehyde, and the blocking agent are dissolved to an extent where no solids are visible (by naked eye in white light) within the solution.

In one or more embodiments, the solids content of the crosslinking composition is adjusted (for example by the addition of water or by the removal of water) to at least 5% by weight, in other embodiments at least 10% by weight, in other embodiments at least 20% by weight, in other embodiments at least 30% by weight, and in other embodiments at least 35% by weight based upon the total weight of the entire composition. In these or other embodiments, the solids content of the crosslinking composition is adjusted to less than 85% by weight, in other embodiments less than 75% by weight, in other embodiments less than 65% by weight, in other embodiments less than 55% by weight, and in other embodiments less than 50% by weight, based upon the total weight of the entire composition.

In one or more embodiments, the crosslinking composition may include at least 2%, in other embodiments at least 4%, in other embodiments at least 6%, and in other embodiments at least 7% by weight of a source of boron, such as boron trioxide, based upon the total solids content of the composition. In these or other embodiments, the crosslinking composition may include less than 14%, in other embodiments less than 12%, in other embodiments less than 10%, and in other embodiments less than 9% by weight of a source of boron, such as boron trioxide, based upon the total solids content of the composition.

In one or more embodiments, the crosslinking composition may include at least 40%, in other embodiments at least 50%, in other embodiments at least 55%, and in other embodiments at least 60% by weight of a dialdehyde, such as glyoxal, based upon the total solids content of the composition. In these or other embodiments, the crosslinking composition may include less than 85%, in other embodiments less than 80%, in other embodiments less than 75%, and in other embodiments less than 70% by weight of a dialdehyde, such as glyoxal, based upon the total solids content of the composition.

In one or more embodiments, the crosslinking composition may include at least 10%, in other embodiments at least 14%, in other embodiments at least 16%, and in other embodiments at least 18% by weight of a blocking agent, such as sorbitol, based upon the total solids content of the composition. In these or other embodiments, the crosslinking composition may include less than 35%, in other embodiments less than 30%, in other embodiments less than 26%, and in other embodiments less than 23% by weight of a blocking agent, such as sorbitol, based upon the total solids content of the composition.

In one or more embodiments, less than a molar equivalent of blocking agent is advantageously needed to effectively block the composition (i.e., block the reactive sites on the dialdehyde (e.g., glyoxal) in order to maintain useful viscosity in solution). It is believed that this advantage derives from the presence of the source of boron (e.g., borate). In one or more embodiments, the moles of blocking agent employed in the composition may be less than 1.0, in other embodiments less than 0.9, in other embodiments less than 0.8, in other embodiments less than 0.7, and in other embodiments less than 0.6, molar equivalents per mole of dialkehyde (e.g., glyoxal). For example, in certain embodiments, 0.5 moles of blocking agent per mole of glyoxal may be employed to prepare a technologically useful composition.

Surface treatment compositions according to the present invention may be prepared by introducing the crosslinking compositions described herein with an aqueous starch composition. Advantageously, it has been unexpectedly discovered that practice of this invention allows for the post addition of dialdehyde (e.g. glyoxal) in forming the surface treatment composition. In other words, the crosslinking composition and the starch can be combined, and then additional glyoxal can be added to the composition.

In one or more embodiments, the amount of crosslinking composition introduced with the starch can be quantified with reference to the solids content of the starch to the solids content of the crosslinking solution (i.e. dry weight to dry weight). In one or more embodiments, at least 1, in other embodiments at least 2, in other embodiments at least 3, and in other embodiments at least 4 parts by weight crosslinking composition (solids) is introduced to 100 parts by weight starch (i.e. solids per 100 parts solids). In these or other embodiments, less than 12, in other embodiments less than 10, in other embodiments less than 7, and in other embodiments less than 5 parts by weight crosslinking composition) is introduced to 100 parts by weight starch (i.e. solids per 100 parts solids).

In one or more embodiments, the surface treatment compositions include sizing compositions. In one or more embodiments, the sizing compositions include at least 3, in other embodiments at least 5, in other embodiments at least 8, and in other embodiments at least 10 percent by weight solids based upon the total weight of the composition. In these or other embodiments, the sizing compositions include less than 30, in other embodiments less than 20, in other embodiments less than 15, and in other embodiments less than 12 percent by weight solids based upon the total weight of the composition.

In one or more embodiments, the sizing compositions include at least 70, in other embodiments at least 75, in other embodiments at least 80, in other embodiments at least 85, in other embodiments at least 90, and in other embodiments at least 95 percent by weight starch, based upon the solids content of the sizing composition. In these or other embodiments, the sizing compositions include less than 100, in other embodiments less than 99, in other embodiments less than 97, and in other embodiments less than 95 percent by weight starch based upon the total weight of the composition.

In one or more embodiments, the sizing compositions include at least 1, in other embodiments at least 2, in other embodiments at least 3, in other embodiments at least 4, in other embodiments at least 5, and in other embodiments at least 7 percent by weight pigment, based upon the solids content of the sizing composition. In these or other embodiments, the sizing compositions include less than 25, in other embodiments less than 20, in other embodiments less than 15, and in other embodiments less than 12 percent by weight pigment based upon the total weight of the composition. In one or more embodiments, the pigment employed within the sizing compositions includes at least 60% by weight, in other embodiments at least 70% by weight, in other embodiments at least 80% by weight, and in other embodiments at least 90% by weight calcium carbonate based upon the total weight of the pigment. In these or other embodiments, the pigment within the sizing compositions is comprised substantially of calcium carbonate.

In one or more embodiments, the surface treatment compositions include highly pigmented coating compositions. In one or more embodiments, the highly pigmented coating compositions include at least 35, in other embodiments at least 40, in other embodiments at least 45, and in other embodiments at least 50 percent by weight solids based upon the total weight of the composition. In these or other embodiments, the pigmented coating compositions include less than 80, in other embodiments less than 75, in other embodiments less than 70, and in other embodiments less than 65 percent by weight solids based upon the total weight of the composition.

In one or more embodiments, the highly pigmented coating compositions include at least 10, in other embodiments at least 75, in other embodiments at least 80, in other embodiments at least 85, in other embodiments at least 90, and in other embodiments at least 95 percent by weight pigment, based upon the solids content of the composition. In these or other embodiments, the pigmented coating compositions include less than 100, in other embodiments less than 99, in other embodiments less than 97, and in other embodiments less than 95 percent by weight pigment based upon the total weight of the composition. In one or more embodiments, the pigment employed within the highly pigmented coating includes at least 60% by weight, in other embodiments at least 70% by weight, in other embodiments at least 80% by weight, and in other embodiments at least 90% by weight calcium carbonate based upon the total weight of the pigment. In these or other embodiments, the pigment within the highly pigmented coating is comprised substantially of calcium carbonate.

In one or more embodiments, the highly pigmented coating compositions include at least 1, in other embodiments at least 2, in other embodiments at least 3, in other embodiments at least 4, in other embodiments at least 5, and in other embodiments at least 7 percent by weight starch, based upon the solids content of the composition. In these or other embodiments, the pigmented coating compositions include less than 25, in other embodiments less than 20, in other embodiments less than 15, and in other embodiments less than 12 percent by weight starch based upon the total weight of the composition.

In one or more embodiments, the highly pigmented coating compositions include at least 2, in other embodiments at least 5, in other embodiments at least 8, in other embodiments at least 10, and in other embodiments at least 12 percent by weight polymer, based upon the solids content of the composition. In these or other embodiments, the pigmented coating compositions include less than 25, in other embodiments less than 20, in other embodiments less than 15, and in other embodiments less than 12 percent by weight polymer based upon the total weight of the composition.

In one or more embodiments, the amount of binder (i.e. starch and polymer) within the paper coating composition is based upon the amount of pigment with the ratio varying with the amount of bonding desired and with the adhesive characteristics of the particular binder employed. In one or more embodiments, the amount of binder is about 5 to 25 percent, and in other embodiments from about 12 to 18 percent, based on the weight of the pigment. The amount of additive varies with the amount and properties of the binder and the amount of insolubilization desired. In one or more embodiments, the additive is added at about 1 to 10 percent, and in other embodiments about 3 to 7 percent, based on the weight of the binder (solids or dry basis). In one or more embodiments, the total solids content of the paper coating composition generally is within the range of about 40 to 70 percent, depending upon the method of application and the product requirements.

In one or more embodiments, especially where the compositions of the present invention are useful as sizing compositions, the surface treatment compositions may be characterized by a viscosity of less than 500 cps, in other embodiments less than 400 cps, and in other embodiments less than 300 cps.

In one or more embodiments, especially where the compositions of the present invention are useful as pigmented coating compositions, the surface treatment compositions may be characterized by a viscosity of less than 2500 cps, in other embodiments less than 2000 cps, and in other embodiments less than 1500 cps.

In one or more embodiments, the surface treatment compositions may be characterized by a pH of at least 5, in other embodiments at least 6.0, in other embodiments at least 6.5, and in other embodiments at least 7.0. In these or other embodiments, the surface treatment compositions may be characterized by a pH of less than 8.5, in other embodiments less than 8.0, and in other embodiments less than 7.5. In other embodiments, particularly where pigments such as calcium carbonate are employed and provide a degree of alkalinity to the compositions, the surface treatment compositions may be characterized by a pH of at least 7.5, in other embodiments at least 7.8, in other embodiments at least 8.5, in other embodiments at least 8.7, in other embodiments at least 9.0, and in other embodiments at least 9.2. In these embodiments where pigments that provide alkylinity to the composition are employed, the pH of the surface treatment composition may be less than 10, in other embodiments less than 9.7, and in other embodiments less than 9.5.

In one or more embodiments, the surface treatment compositions of the present invention may be employed to treat cellulosic substrates. These cellulosic substrates include paper and paper board. Examples include wood free paper such as those having a basis weight of from about 50 to about 110 gsm, web offset paper having a basis weight of from about 30 to about 100 gsm, lightweight paper having a basis weight of from about 24 to about 60 gsm, and paperboard having a basis weight of from about 90 to about 180 gsm.

These cellulosic substrates may be treated by using conventional techniques for treating paper and paper board.

It has unexpectedly been discovered that the use of the surface treatment compositions of the present invention yield surface treated cellulosic substrates (e.g. sized or coated paper) that demonstrate advantageous surface properties, particularly as demonstrated by the Adams Wet Rub Test, and yet the surface treatment compositions have a technologically useful viscosity, which is particularly important for paper coating processes. Other advantages may include increased flame retardancy of the substrates.

In order to demonstrate the practice of the present invention, the following examples have been prepared and tested. The examples should not, however, be viewed as limiting the scope of the invention. The claims will serve to define the invention.

EXAMPLES

Various crosslinking compositions were prepared and added to a paper coating formulation. The paper coating formulation was analyzed for processability characteristics and paper was coated and tested for performance characteristics.

The crosslinking compositions were prepared by combining, in the aqueous phase, the ingredients set forth in Table I, which reports the ingredients in % by mole weight of the materials as received. In the case of Sample 2, glyoxal and sorbitol were reacted in the presence of borax; in the case of Sample 3, a portion of the glyoxal was post added after the reaction; and in the case of Sample 4, it had the same composition as Sample 3 but without borate. The polyol used to manufacture Sample 1 was a vicinal polyol (corn syrup) and there are many other polyols believed to be included.

TABLE I

| Sample | 1 | 2 | 3 | 4 | 5 |
|---|---|---|---|---|---|
| Glyoxal | 53.2% | 50.4% | 36.8% | 36.8% | — |
| Sorbitol | None | 12% | 8.8% | 8.8% | — |
| Corn Syrup | 36.5% | None | None | None | — |
| Borax | None | 18.5% | 16.7% | None | 100% |
| Glyoxal-Post Add | None | None | 29.9% | None | None |

Following preparation of the crosslinking compositions, highly pigmented paper coating formulations were prepared, in the aqueous phase, by employing the ingredients set forth in Table II, which is a typical coating for lightweight papers. The amounts provided in Table II are based on the dry total weight. Each paper coating formulation was adjusted to about 59% solids, and each formulation was split into two samples. A first set of samples was adjusted to a pH of 7.8, and a second set of samples was adjusted to a pH of 9.0 with sodium hydroxide. The only exception was the formulation with borax where, to achieve equivalent mole content with Sample 2 and Sample 3, borax was added at levels 0.04%, 0.07%, and 0.11%

TABLE II

| Ingredients | Amounts (parts by weight solids) |
|---|---|
| Pigment | |
| Kaolin Clay (#1) | 50 |
| Ground Calcium Carbonate | 50 |
| Starch | 8 |
| Polymer Latex | 8 |
| Dispersant | 0.15 |
| Crosslinker | Varied |

The viscosity of each paper coating formulation is reported in Table III or Table IV, where Table III relates to those paper coating formulations adjusted to a pH of 7.8 and Table IV relates to those paper coating formulations that were adjusted to a pH of 9.0. The viscosity of the coating formulations was analyzed by employing (a) a Brookfield (BFV) viscometer with a spindle rotating at 100 rpm and 20 rpm, and (b) a Hercules Hi-Shear (HHS) viscometer with a bob-and-cup geometry rotating from 0 to 4400 rpm.

TABLE III

| | Crosslinker Parts by weight/100 parts pigment | | | | |
|---|---|---|---|---|---|
| | Viscosity, cps | BFV 20 | HHS 4400 | pH | TSC |
| Sample | 1918 | 5830 | 49.2 | 7.8 | 59.2 |
| 1 | 1950 | 5620 | 41.4 | 7.8 | 59.1 |
| 1 | 1922 | 5920 | 45.3 | 7.8 | 58.9 |
| 1 | 1838 | 5460 | 44.4 | 7.8 | 58.9 |
| 2 | 1932 | 5940 | 43.8 | 7.8 | 58.9 |
| 2 | 2296 | 6920 | 44.2 | 7.7 | 58.8 |
| 2 | 2476 | 7320 | 45.6 | 7.8 | 59.0 |
| 3 | 2104 | 6060 | 44.2 | 7.7 | 58.9 |
| 3 | 2324 | 6500 | 45.6 | 7.7 | 58.9 |
| 3 | 2560 | 7820 | 51.3 | 7.7 | 58.8 |
| 4 | 2288 | 6800 | 42.3 | 7.6 | 58.9 |
| 4 | 2392 | 6720 | 45.1 | 7.5 | 58.8 |
| 4 | 2552 | 7300 | 45.3 | 7.4 | 58.8 |

TABLE III-continued

| | Crosslinker Parts by weight/100 parts pigment | | | | |
|---|---|---|---|---|---|
| | Viscosity, cps | BFV 20 | HHS 4400 | pH | TSC |
| 5 | 1976 | 5760 | 41.9 | 7.6 | 58.9 |
| 5 | 1856 | 5540 | 38.4 | 7.4 | 58.4 |
| 5 | 1680 | 4720 | 37.7 | 7.5 | 58.2 |

TABLE IV

| | Crosslinker Parts by weight/100 parts pigment | | | | |
|---|---|---|---|---|---|
| | BFV 100 | BFV 20 | HHS 4400 | pH | TSC |
| Sample | 2096 | 5740 | 47.5 | 9.0 | 59.5 |
| 1 | 2004 | 6300 | 43.8 | 9.0 | 59.5 |
| 1 | 2016 | 6220 | 44.8 | 9.0 | 59.7 |
| 1 | 2072 | 6300 | 44.8 | 9.0 | 59.7 |
| 2 | 2272 | 6320 | 47.9 | 9.0 | 59.7 |
| 2 | 2532 | 7960 | 49.8 | 9.0 | 59.6 |
| 2 | 2820 | 8100 | 49.5 | 9.0 | 59.6 |
| 3 | 2296 | 7080 | 45.2 | 9.0 | 59.5 |
| 3 | 2524 | 7400 | 47.9 | 9.0 | 59.5 |
| 3 | 2736 | 8380 | 48.7 | 9.0 | 59.6 |
| 4 | 2140 | 6500 | 42.6 | 9.0 | 59.5 |
| 4 | 2264 | 6200 | 43.8 | 9.0 | 59.5 |
| 4 | 2256 | 6260 | 44.8 | 9.0 | 59.7 |
| 5 | 2044 | 5840 | 46.3 | 9.0 | 59.6 |
| 5 | 2080 | 6520 | 42.4 | 9.0 | 59.2 |
| 5 | 1980 | 5340 | 41.8 | 9.0 | 59.0 |

Wet coating evaluations of coating viscosities showed that Sample 2 and Sample 3 had approximately a 20-30% increase in BFV at 100 rpm. Sample 2 had approximately a 10-15% increase. The HHS viscosity values were not significantly affected by the choice of crosslinking composition.

Each paper coating formulation was applied to coat a 81 lbs/3300 sq ft woodfree paper, like the ones used for magazines, with 7 lbs/3300 sq ft coating weight by employing wire-rod drawdowns and drying the paper with a hot infrared gun and forced air. After drying, all papers were calendered in a laboratory supercalender to achieve paper 75° gloss as close as possible to 60% (TAPPI Standard Method T 480 om-92). These are common coating, laboratory application, and testing techniques for evaluation of paper coatings. The results are reported in Table V.

Evaluations methods to determine the efficiency of coating insolubilizers used the Adams Wet Rub Test (AWRT). The principle of testing is based on applying a rubbing action under controlled conditions and for a pre-determined period of time on a continually wetted paper sample and examining the rub-off material. Two methods of detection were employed; one is the measurement of coating removed in 20 seconds and obtaining a quantifiable absorbance value. Lower colorimetric absorbance values correspond to less material rubbed off the coated paper, therefore better crosslinking. The other method is conducted using the same test procedure but results are determined by the percent transmittance values of the rubbed material. Higher % T values correspond to more efficient crosslinking.

TABLE V

| | % Transmittance | | | | Colorimetric Data | | | |
|---|---|---|---|---|---|---|---|---|
| | 7.8 pH | % Change vs Blank | 9.0 pH | % Change vs Blank | 7.8 pH | % Change vs Blank | 9.0 pH | % Change vs Blank |
| Blank (0.0) | 71.6 | — | 66.2 | — | 0.584 | — | 0.578 | — |
| Sample 1 | 85.1 | 18.9 | 69.1 | 4.4 | 0.437 | 25.2 | 0.524 | 9.34 |
| Sample 1 | 87.4 | 22.0 | 77.0 | 16.3 | 0.267 | 54.3 | 0.436 | 24.57 |
| Sample 1 | 88.4 | 23.5 | 85.7 | 29.4 | 0.330 | 43.5 | 0.321 | 44.55 |
| Sample 2 | 84.9 | 18.6 | 73.0 | 10.3 | 0.304 | 47.9 | 0.391 | 32.35 |
| Sample 2 | 93.2 | 30.2 | 85.3 | 28.8 | 0.304 | 47.9 | 0.237 | 59.08 |
| Sample 2 | 94.4 | 31.8 | 93.9 | 41.8 | 0.218 | 62.7 | 0.159 | 72.49 |
| Sample 3 | 88.8 | 24.0 | 87.7 | 32.4 | 0.312 | 46.6 | 0.302 | 47.75 |
| Sample 3 | 95.7 | 33.7 | 92.4 | 39.5 | 0.203 | 65.2 | 0.223 | 61.42 |
| Sample 3 | 97.4 | 36.0 | 95.4 | 44.1 | 0.156 | 73.3 | 0.140 | 75.87 |
| Sample 4 | 67.8 | −5.3 | 66.7 | 0.8 | 0.522 | 10.6 | 0.571 | 1.30 |
| Sample 4 | 72.0 | 0.5 | 68.5 | 3.5 | 0.521 | 10.9 | 0.548 | 5.19 |
| Sample 4 | 69.7 | −2.7 | 66.7 | 0.8 | 0.568 | 2.7 | 0.595 | −2.94 |
| Sample 5 | 70.5 | −1.5 | 68.4 | 3.3 | 0.540 | 7.5 | 0.531 | 8.13 |
| Sample 5 | 83.6 | 16.8 | 80.1 | 21.0 | 0.365 | 37.6 | 0.490 | 15.31 |
| Sample 5 | 89.7 | 25.2 | 88.3 | 33.3 | 0.302 | 48.3 | 0.346 | 40.22 |

One of the advantageous and unexpected findings associated with the present invention is the usefulness of the coating composition, at higher pH. Table VI shows this stability. In particular, Table VI shows that the change in properties, as reported in Table V, as the pH was raised from 7.8 to 9.0. As those skilled in the art appreciate, the smaller the change as the alkylidity increased is advantageous, and as can be seen from the data, those compositions representing the present invention proved superior.

TABLE VI

| | % (% T) Change | % Abs Change |
|---|---|---|
| Blank (0.0) | 7.5 | 1.0 |
| Sample 1 | 18.8 | −19.9 |
| Sample 1 | 11.8 | −63.3 |
| Sample 1 | 3.1 | 2.9 |
| Ave | 11.2 | −26.8 |
| Sample 2 | 3.1 | −28.6 |
| Sample 2 | 14.0 | 22.2 |
| Sample 2 | 8.5 | 27.1 |
| Ave | 8.5 | 6.9 |
| Sample 3 | 1.3 | 3.2 |
| Sample 3 | 3.4 | −9.9 |
| Sample 3 | 2.1 | 10.6 |
| Ave | 2.3 | 1.3 |
| Sample 4 | 1.6 | −9.3 |
| Sample 4 | 4.8 | −5.3 |
| Sample 4 | 4.2 | −4.8 |
| Ave | 3.6 | −6.4 |
| Sample 5 | 3.0 | 1.7 |
| Sample 5 | 4.2 | −34.3 |
| Sample 5 | 1.5 | −14.4 |
| Ave | 2.9 | −15.7 |

Various modifications and alterations that do not depart from the scope and spirit of this invention will become apparent to those skilled in the art. This invention is not to be duly limited to the illustrative embodiments set forth herein.

What is claimed is:

1. A method of preparing a surface-treated cellulosic substrate, the method comprising:

applying a surface treatment composition to a cellulosic substrate, the composition being prepared by a method comprising the steps of:

(a) introducing (i) a source of boron, (ii) a crosslinking di-aldehyde, and (iii) a blocking agent to form a crosslinking composition;

(b) introducing the crosslinking solution with starch and optionally pigments and/or optionally polymeric particles to form the composition, where the surface treatment composition is characterized by a pH from about 7 to about 9.

2. The method of claim 1, where the surface treatment composition is characterized by a viscosity of less than 2500 cps.

3. The method of claim 1, wherein the surface treatment composition is characterized by a solids content of from about 30 to about 80.

4. The method of claim 1, wherein the starch is selected from the group consisting of modified starches and natural starches.

5. The method of claim 1, where the starch is selected from the group consisting of ethylated (hydroxylated) starch, peroxide-treated starch (acid modified), and cationized starch.

6. The method of claim 1, wherein the dialdehyde includes glyoxal.

7. The method of claim 1, wherein the surface treatment composition includes a pigment selected from the group consisting of kaolin clay, calcium carbonate, titanium dioxide, gypsum, talc, and plastic pigments.

8. The method of claim 1, wherein the polymer particles are selected from the group consisting of elastomeric particles, styrene acrylates, and polyvinyl acetate particles.

9. The method of claim 1, wherein the polymer particles include styrene-butadiene latexes and derivatives thereof.

10. The method of claim 1, wherein the cellulosic substrate includes paper or paper board.

11. The method of claim 1, where said step of applying forms a coating on at least one surface of the cellulosic substrate, and wherein the wet thickness of the coating is from about 1 to about 30 microns.

12. The method of claim 1, wherein the source of boron includes a borate.

13. The method of claim 1, where the surface treatment composition includes calcium carbonate pigment and is characterized by a pH of at least 8.5.

14. The method of claim 1, where said step of introducing a source of boron and a dialdehyde includes introducing an aqueous borate solution and an aqueous glyoxal solution.

15. The method of claim 1, where the blocking agent includes a compound that binds chemically to the di-aldehyde and upon a threshold level of dehydration, will allow the di-aldehyde to react and crosslink starch.

16. The method of claim 1, where the blocking agent includes pentaerythritol, glycerin, lanolin, a mono or oligosaccharide having multiple hydroxyl groups, or a mixture thereof.

17. The method of claim 1, where the blocking agent includes sorbitol.

18. The method of claim 1, where the blocking agent includes pentaerythritol.

* * * * *